US010253978B2

(12) United States Patent
Kowald et al.

(10) Patent No.: US 10,253,978 B2
(45) Date of Patent: Apr. 9, 2019

(54) GAS-AIR MIXER ASSEMBLY

(71) Applicant: Lennox Industries Inc., Richardson, TX (US)

(72) Inventors: Glenn W. Kowald, Carrollton, TX (US); Charles Post, Mesquite, TX (US); Ian Burmania, Rockwall, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 15/456,058

(22) Filed: Mar. 10, 2017

(65) Prior Publication Data

US 2018/0259179 A1 Sep. 13, 2018

(51) Int. Cl.

| | |
|---|---|
| ***F23D 14/02*** | (2006.01) |
| ***B01F 5/06*** | (2006.01) |
| ***B01F 5/04*** | (2006.01) |
| ***B01F 3/02*** | (2006.01) |
| ***F23N 1/00*** | (2006.01) |

(52) U.S. Cl.

CPC ..... *F23D 14/02* (2013.01); *B01F 3/02* (2013.01); *B01F 5/0451* (2013.01); *B01F 5/0461* (2013.01); *B01F 5/0647* (2013.01); *F23N 1/002* (2013.01); *F23N 1/005* (2013.01); *F23D 2203/007* (2013.01)

(58) Field of Classification Search

CPC B01F 5/0463; B01F 5/0647; B01F 15/00162; B01F 15/026; F23D 14/02

USPC ..... 261/40, 76–77, 119.2, 121.2; 366/106–107, 178.1–178.3, 182.4

See application file for complete search history.

(56) References Cited

U.S. PATENT DOCUMENTS 1,570,951 A * 1/1926 Downing ..... F23D 11/10 239/127
2,852,239 A * 9/1958 Vicard ..... B01D 47/10 261/116
2,953,306 A * 9/1960 Dijkstra ..... B01F 3/0446 239/417.3
3,275,057 A * 9/1966 Ward ..... C03B 5/235 431/283
3,915,625 A * 10/1975 Hapgood ..... F23C 7/00 431/264
3,957,421 A * 5/1976 Wikman ..... F23D 14/02 431/353
4,019,983 A * 4/1977 Mandt ..... B01F 5/0212 210/220
4,963,329 A * 10/1990 Burgess ..... B01D 53/34 261/117
5,176,448 A * 1/1993 King ..... B01F 5/045 366/174.1

(Continued)

*Primary Examiner* — Abbas Rashid

(74) *Attorney, Agent, or Firm* — Baker Botts L.L.P.

(57) ABSTRACT

A gas-air mixer assembly is described that helps mix fuel and air within an HVAC system. The mixer assembly can also achieve lower pressure drops than seen in other solutions. A mixer assembly can comprise a mixer body through which air is supplied. An orifice body can extend into the stream of air within the mixer body and then point upstream. A tip of the orifice body, disposed in the airstream, can provide fuel through one or more orifices. The flow of air around the orifice body helps to cause mixing, as does an elbow bend in the mixer body, downstream of the orifice body.

7 Claims, 7 Drawing Sheets

(56) References Cited

U.S. PATENT DOCUMENTS

| | | | | | |
|---|---|---|---|---|---|
| 5,362,464 | A * | 11/1994 | Burgess | B01D 53/34 | 423/239.1 |
| 5,865,537 | A * | 2/1999 | Streiff | B01F 3/10 | 366/137 |
| 5,931,657 | A * | 8/1999 | Klouda | F23D 14/02 | 431/181 |
| 6,027,241 | A * | 2/2000 | King | B01F 3/0873 | 138/38 |
| 6,279,611 | B2 * | 8/2001 | Uematsu | B01F 5/0451 | 137/888 |
| 8,163,807 | B2 * | 4/2012 | Katsuhara | B01F 3/0807 | 366/76.2 |
| 9,004,744 | B1 * | 4/2015 | Kemp | B01F 5/108 | 366/167.1 |
| 9,545,606 | B2 * | 1/2017 | Cloeter | B01F 5/0451 | |
| 9,581,068 | B2 * | 2/2017 | Kumagai | F01N 11/00 | |
| 2007/0126133 | A1 * | 6/2007 | Galgano | B01F 3/0876 | 261/77 |

* cited by examiner

GAS-AIR MIXER ASSEMBLY

TECHNICAL FIELD

The present disclosure is directed to HVAC systems and more particularly to gas-air mixers.

BACKGROUND OF THE INVENTION

The use of gas-air mixers helps to provide a homogenous or proper ratio supply of gas and air to a premix burner in a heat exchanger system. A poorly mixed, improper ratio of gas and air can result in poor lighting, flame flashback, and poor combustion. Some HVAC systems accomplish mixing by use of an upstream blower assembly. However, such blower assemblies have drawbacks that prevent their use in residential applications. These drawbacks can include creating a positive pressure in burner and heat train creating potential safety concerns, space constraints, and expensive construction requirements.

BRIEF SUMMARY OF THE INVENTION

One embodiment of the present disclosure comprises a fuel-air mixer assembly for use in HVAC systems comprising: a tube comprising an inlet and an outlet, the tube comprising a bend between the inlet and the outlet, the inlet configured to receive a supply of air; an orifice body at a location upstream of the bend, the orifice body comprising a first portion extending from a tube wall into the interior of the tube and a second portion extending upstream within the interior of the tube, the first and second portions connected by a curve, the second portion comprising a tip distal to the curve, the tip comprising one or more orifices operable to direct a supply of fuel into the tube.

Another embodiment under the present disclosure comprises a fuel-air mixer assembly for use in an HVAC system, comprising: a first portion comprising a tubular shape and comprising an inlet and an orifice body, the inlet operable to receive a supply of air, the orifice body comprising an elbow-shape and extending into the interior of the fuel-air mixer assembly and then extending upstream, the orifice body comprising one or more orifices operable to direct a supply of fuel to the first portion; and a second portion connected to the first portion by a bend downstream of the orifice body, the second portion comprising a tubular shape and an outlet operable to deliver a mix of fuel and air to another component of the HVAC system; wherein a first distance comprises a length between the outlet and a first axis defined by the center of the first portion, and a second distance comprises a length between the one or more orifices and a second axis defined by the center of the second portion, and wherein the second distance is greater than the first distance.

Another embodiment under the present disclosure comprises a method of constructing a fuel-air mixer assembly for an HVAC system, comprising: providing a mixer body, the mixer body comprising an elbow shape, an inlet, and an outlet, the inlet operable to receive a supply of air and the mixer body comprising a bend between the inlet and the outlet, the mixer body further comprising an opening upstream of the bend; coupling an orifice body to the opening, the orifice body comprising an elbow shape, and extending into the interior of the mixer body and then extending upstream toward the inlet, the orifice body operable to receive fuel from outside of the mixer body, the orifice body comprising one or more orifices operable to direct fuel into the mixer body.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Mixing of the gas-air stream for premix combustion is typically accomplished by mechanical agitation via an upstream blower assembly. While this method provides a well blended gas-air mixture to the burner, it is undesirable for residential furnaces for several reasons. One, the blower creates a positive pressure in the burner and heat exchanger (a possible safety concern if leaks occur). Two, it's bulky and it's difficult to fit the blower/gas valve assembly into the required space. Three, it requires a costly specialized blower and gas valve assembly. Maintaining a proper ratio of gas and air is critical to the performance of a premix burner. A lean gas-air supply can result in poor lighting, noise and poor combustion while a rich gas-air supply can result in high emissions and combustion resonance. A venturi manifold is commonly used in combination with a 1:1 regulating gas valve. While this method can provide a consistent gas-air ratio to the burner, it can take up a lot of space, require a specialized gas valve assembly, and the venturi manifold must be sized for a target input rate requiring multiple parts to meet the needs of a residential furnace line. A venturi manifold can therefore be hard to implement.

Figure 1:
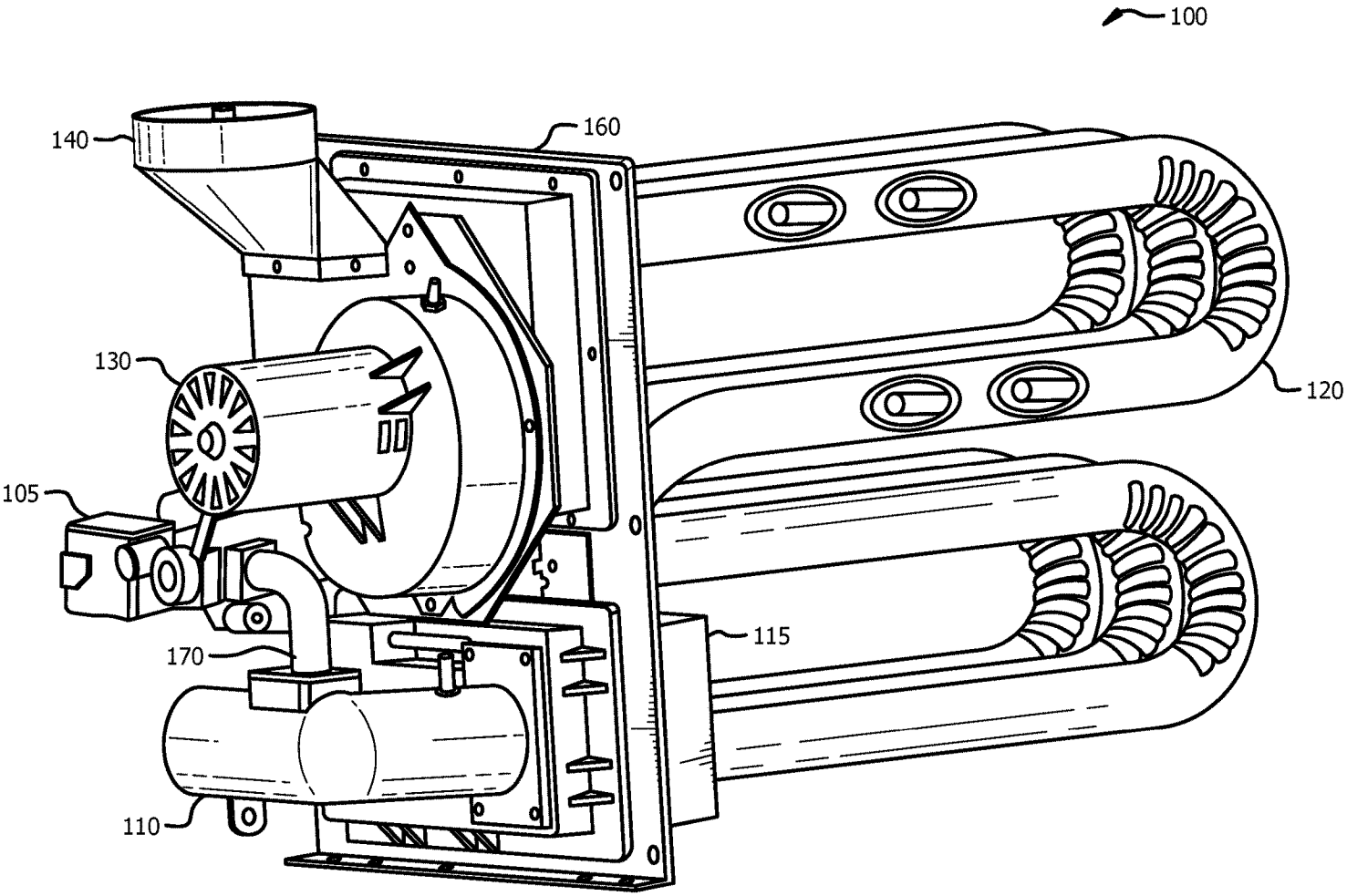
FIG. 1 is a diagram of a possible embodiment under the present disclosure.

Solutions under the present disclosure help to solve the shortcomings of the prior art. Turning to FIG. 1, a possible embodiment of a furnace under the present disclosure can be seen. Furnace 100 comprises gas valve 105 which provide gas to the mixer assembly 110 via tube 170. The burner assembly 115 helps to combust the gas-air mixture and direct the combusted material into heat exchanger tubes 120. Flue exhaust fan 130 pulls material through the heat exchanger tubes by creating a negative pressure differential. Exhaust 140 directs material away from the furnace 100. Plate 160 can provide a connection surface or through-holes for various components of furnace 100.

Figure 2:
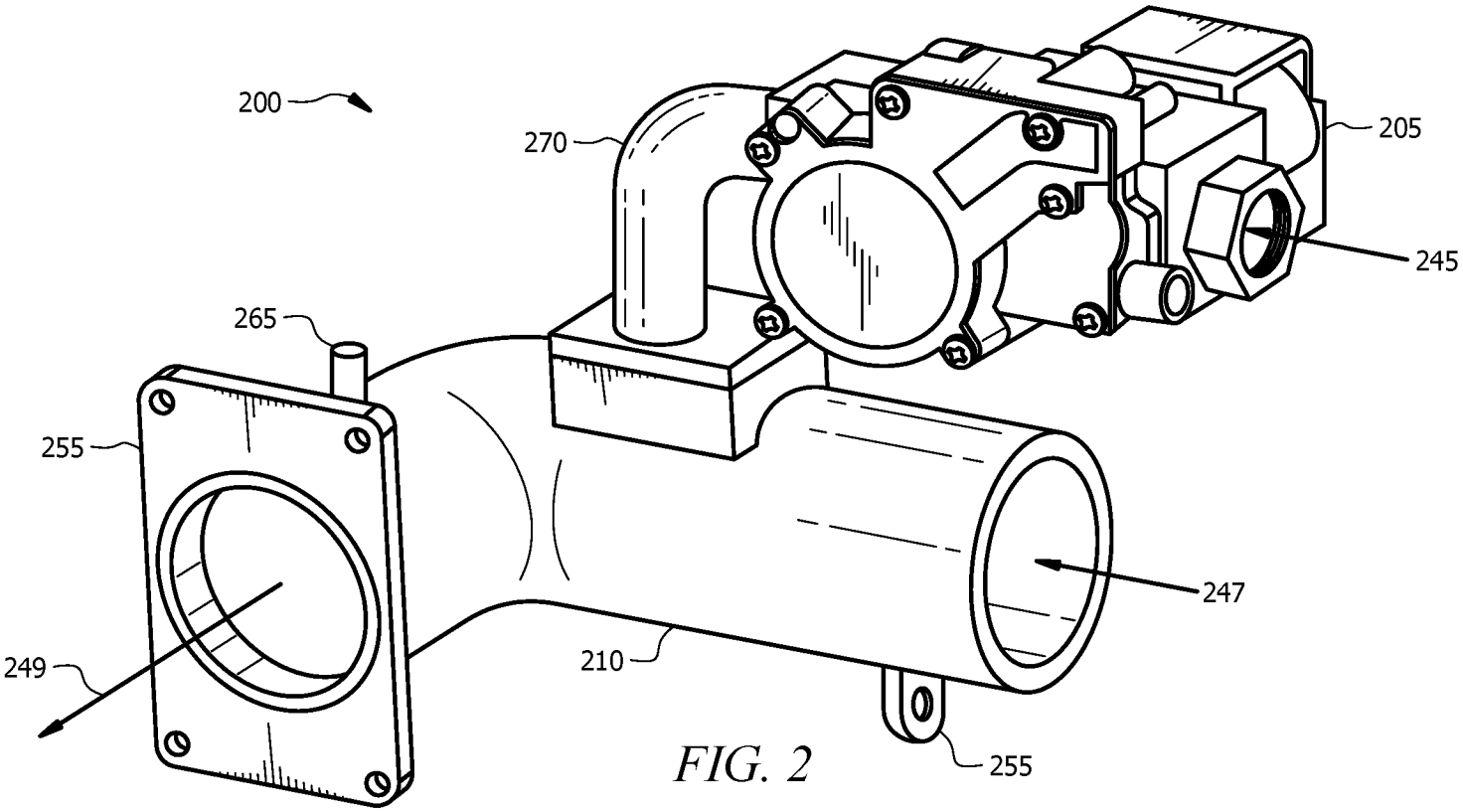
FIG. 2 is a diagram of a possible embodiment under the present disclosure.

Referring to FIG. 2, a more detailed view of embodiments of a gas valve 205 and mixer assembly 210 can be seen (elements 105, 110 in FIG. 1). Gas valve 205 receives a stream of gas 245 and directs the gas through tube 270 to be mixed with air stream 247 in the mixer assembly 210. Mixing the gas 245 and air 247 leads to a gas-air mix 249. Mixer assembly 210 can optionally comprise a variety of attachment mechanisms 255 (brackets, holes, connectors, welding or sauntering points, or other means) or pressure sensor holes 265. Gas-air mix 249 can be provided to burner 115 shown in FIG. 1.

Figure 3:
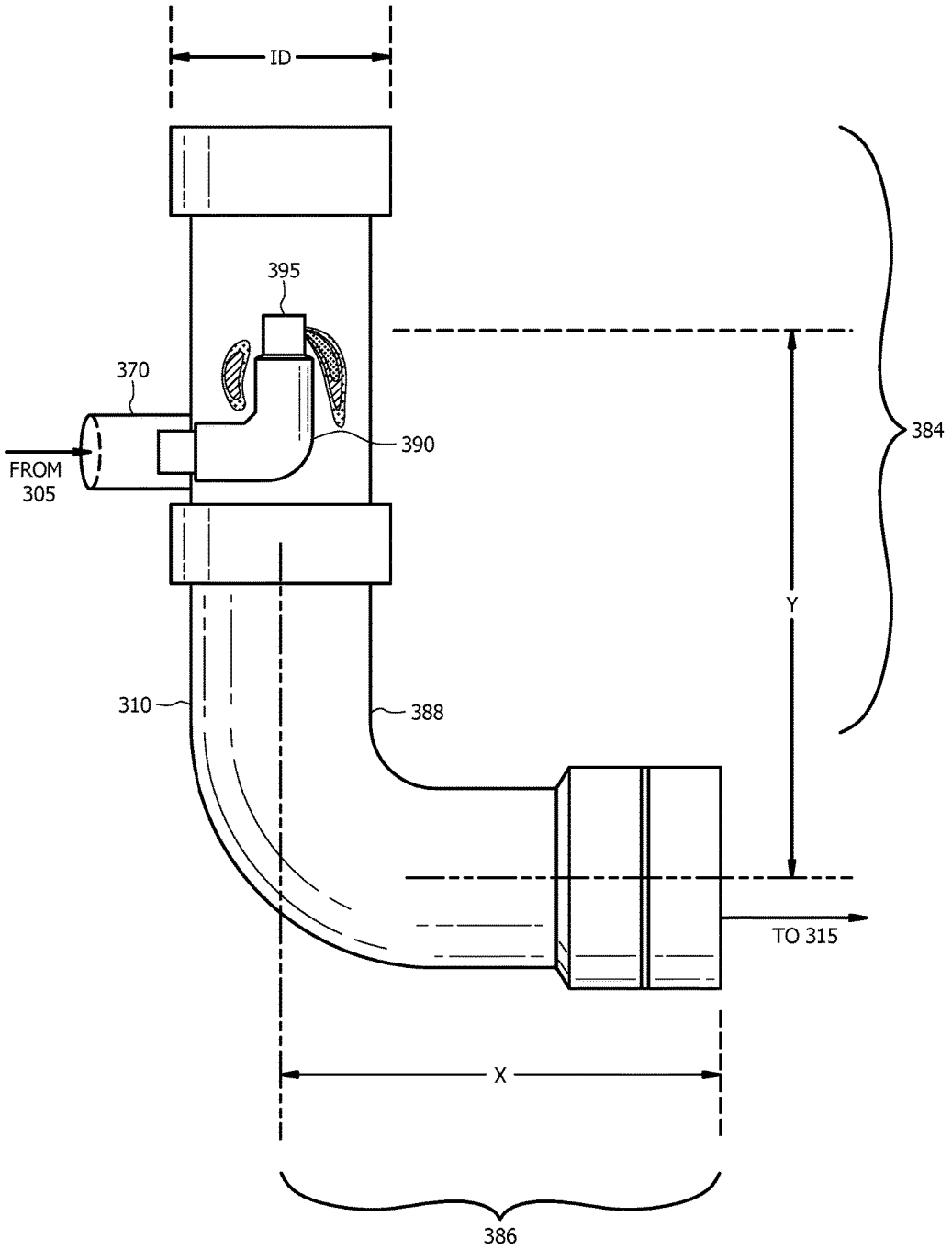
FIG. 3 is a diagram of a possible embodiment under the present disclosure.

FIG. 3 displays a possible embodiment of a gas orifice 390 providing gas to mixer assembly 310. Orifice 390 can comprise the means by which gas tube 170, 270, 370 provides gas to a mixer assembly 110, 210, 310. In a preferred embodiment, orifice 390 comprises an elbow-shape and extends into mixer assembly 310 perpendicularly to the flow of air (a first part), then turns and extends parallel against the flow of air (a second part). Gas can be released from one or more orifices 395 along the length or tip of orifice body 390. Mixer assembly 310 can comprise an inner diameter ID. The second part of the orifice body will preferably be disposed about the center of the mixer assembly, or about the midpoint of inner diameter ID. However, other setups are possible. The mixer assembly 310 can be divided into a first portion 384, upstream of the elbow bend 388, and a second portion 386, downstream of the bend 388. A distance from the one or more orifices 395 to a line bisecting the second portion 386, can comprise a distance Y. A distance from a line bisecting the first portion 384 to the outlet of mixer assembly 310 can comprise a distance X. It will generally be desired that Y>X. For example, it may be desired that Y:X be from 1.1:1 to 2:1. Greater or smaller ratios may be used depending on a user's needs without straying from the teachings of the current disclosure.

Both the orifice body 390 and the mixer assembly (or mixer body) 310 can have an elbow shape. Orifice body 390 can extend in a direction perpendicular to air flow in mixer assembly 310, and then extend parallel to air flow. However, the exact angles can differ, possibly by up to ±15 degrees. It is generally desired for the orifice to extend into the interior of mixer assembly 310, and then against the direction of airflow. Similarly, regarding the mixer assembly 390, a line bisecting the first portion 384, and a line bisecting the second portion 386, will preferably be at a right angle (90 degrees, ±5 degrees). However, various embodiments can use other angles to achieve a desired mix of fuel and air, and to fit within given space constraints.

The exact shape and size of orifice(s) 395 can differ. In a preferred embodiment, orifices 395 are located on the lateral sides of the tip of body 390. Example embodiments can include four small orifices equidistant around the circumference of body 390, a plurality of orifices 395 along the length of body 390, a plurality of slots around the tip and circumference of body 390, one or more orifices 395 on the very tip of body 390, or other layouts. A preferred embodiment comprises six orifices around the top tip along the circumference of body 390.

Figure 4:
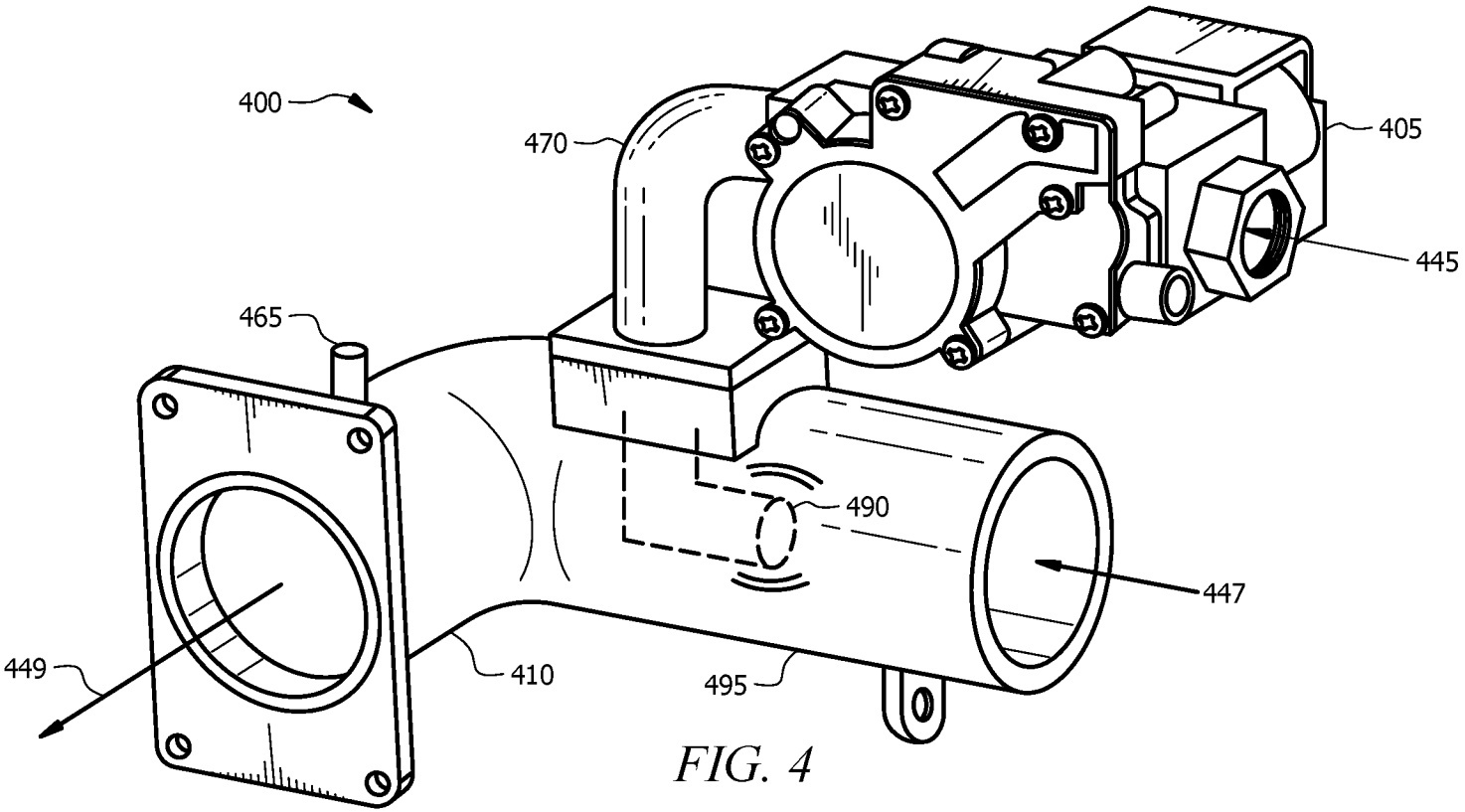
FIG. 4 is a diagram of a possible embodiment under the present disclosure.

FIG. 4 shows a possible embodiment showing details from FIGS. 2 and 3. Gas valve 405 provides gas 445 to mixer assembly 410 via tube 470 and orifice body 490. Orifice body 490 comprises one or more orifice(s) 495. Air stream 447 mixes with gas 445 and mixing also occurs due to the bend 465 in mixer assembly 410. Gas-air mix 449 is then provided to a burner or other components of a furnace (not shown).

Figure 5:
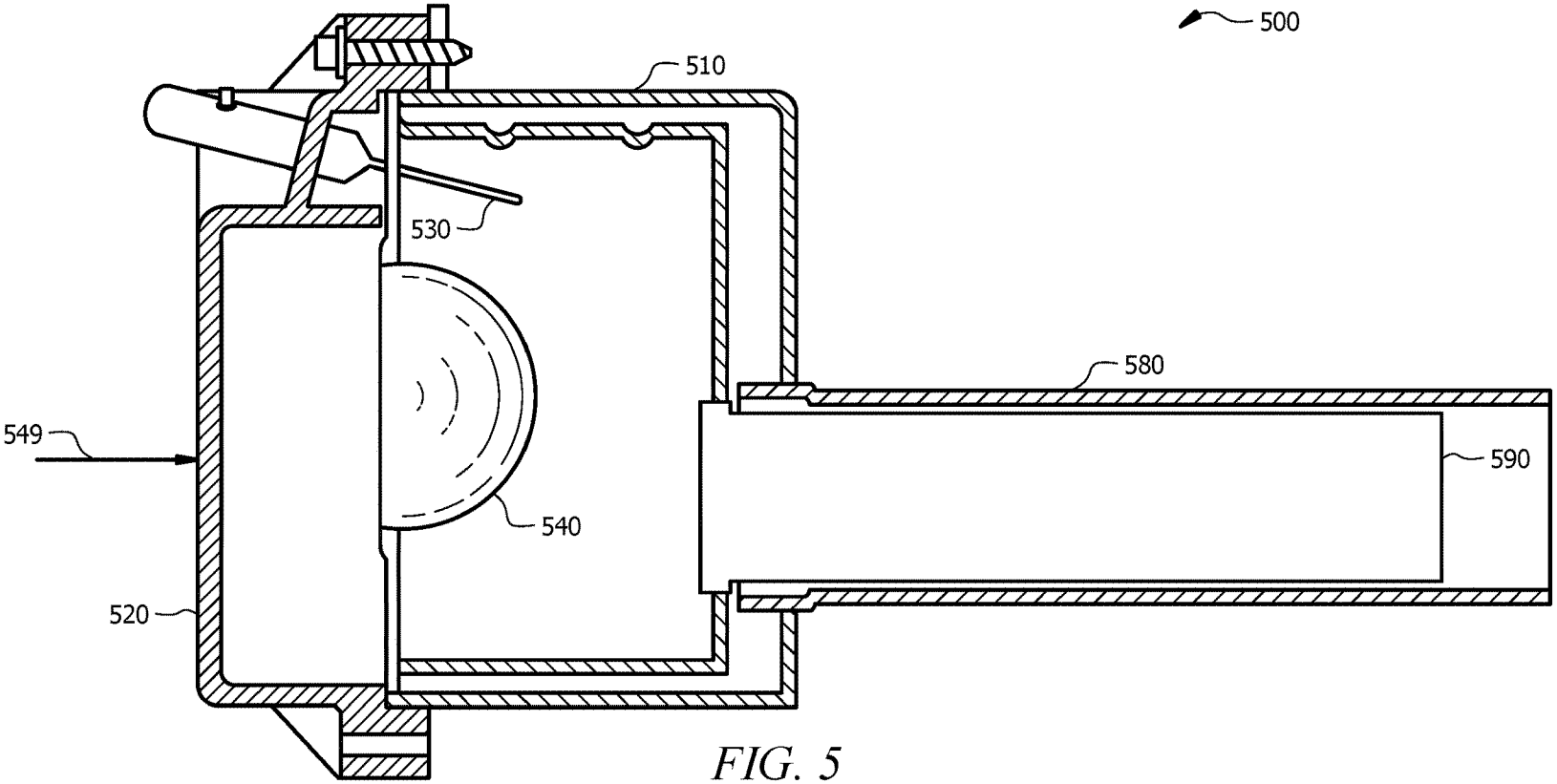
FIG. 5 is a diagram of a possible embodiment under the present disclosure.

FIG. 5 displays a possible embodiment of a burner 500 that may be used in conjunction with a mixer assembly as described in the present disclosure. Burner 500 receives gas-air mixture 549, from a mixer assembly (not shown) or other intervening components. Plenum 520 can divide gas-air mixture 549 into multiple streams. Premix burner 540 can burn at least a portion of mixture 549 and igniter 530 can ignite the mixture within combustion chamber 510. Heat exchanger tube 590 receives the combusted material via extension tube 580 that extends from combustion chamber 510.

Alternative forms of this invention could include different tube diameters or shapes to vary clearances between gas orifice and outer walls to maximize mixing while maintaining acceptable pressure drop. Mixer length could be varied to help attenuate combustion resonance. Another alternate construction might add inlet and outlet effects to the outer tube to vary flow rate, improve mixing, or provide a useful signal pressure for gas-air control linkage. For instance, a fixed orifice, venturi or flow tube could be applied to the mixer inlet to create a useful signal pressure for control, safety monitoring, or combustion airflow measurement. Another alternate feature might incorporate a screen or mesh material at the mixer inlet as a debris shield. Screen size could vary to provide more or less filtering for specific applications as required. Another alternate feature might incorporate a connection port for combustion resonance attenuation devices, such as a quarter-wave tube or Helmholtz resonator.

Figure 6:
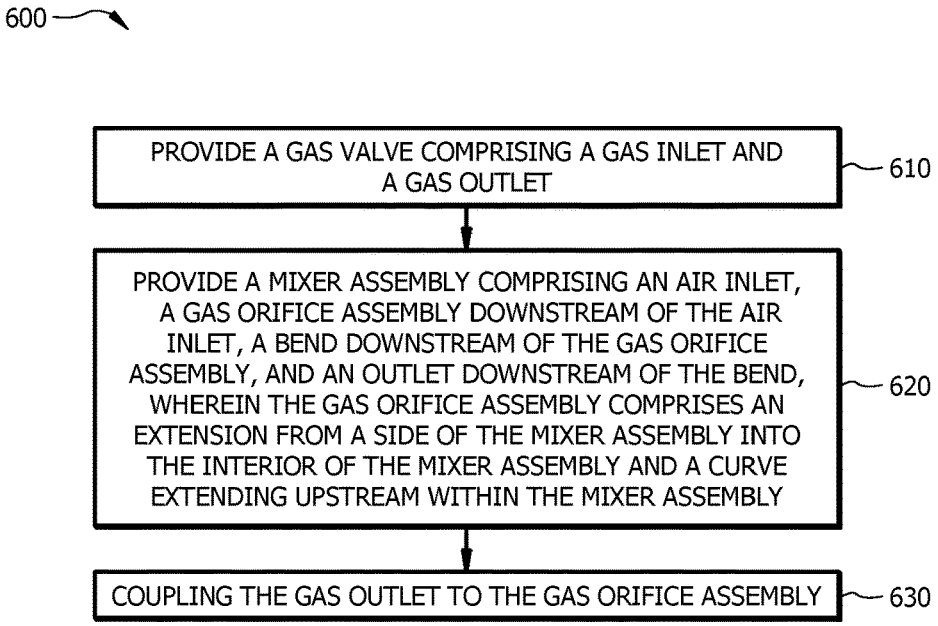
FIG. 6 is a flow chart diagram of a possible method embodiment under the present disclosure.

FIG. 6 displays a possible method embodiment 600 under the present disclosure. At 610, a gas valve is provided comprising a gas inlet and a gas outlet. At 620 a mixer assembly is provided, the mixer assembly comprising an air inlet, a gas orifice assembly downstream of the air inlet, a bend downstream of the gas orifice assembly, and an outlet downstream of the bend, wherein the gas orifice assembly comprises an extension from a side of the mixer assembly into the interior of the mixer assembly and a curve extending upstream within the interior of the mixer assembly. At 630, the gas outlet is coupled to the gas orifice assembly.

Figure 7:
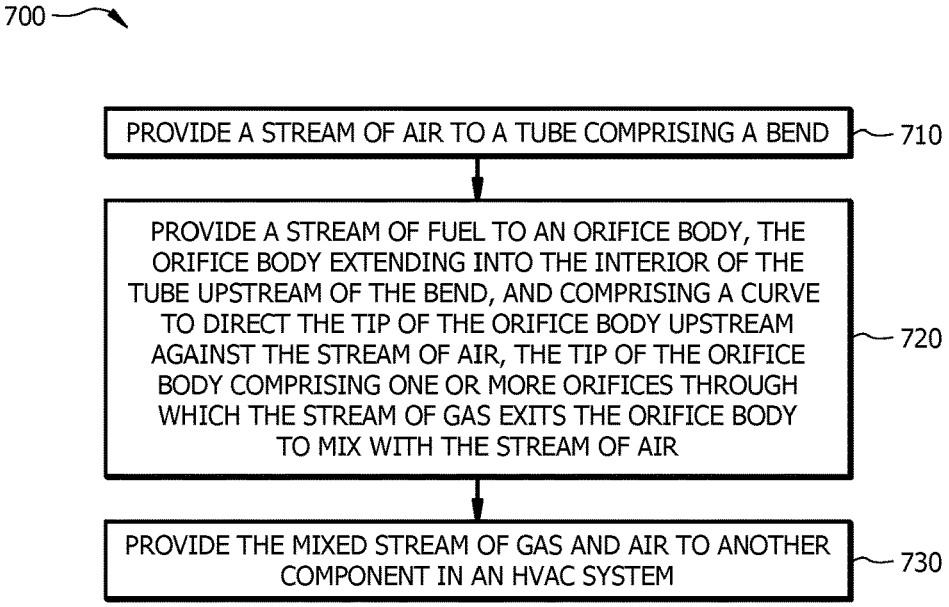
FIG. 7 is a flow chart diagram of a possible method embodiment under the present disclosure.

FIG. 7 displays another possible method embodiment 700 under the present disclosure. At 710, a stream of air is provided to a tube comprising a bend. At 720, a stream of fuel is provided to an orifice body, the orifice body extending into the interior of the tube upstream of the bend, and comprising a curve to direct the tip of the orifice body upstream against the stream of air, the tip of the orifice body comprising one or more orifices through which the stream of gas exits the orifice body to mix with the stream of air. At 730, the mixed stream of gas and air is provided to another component in an HVAC system.

Figure 8:
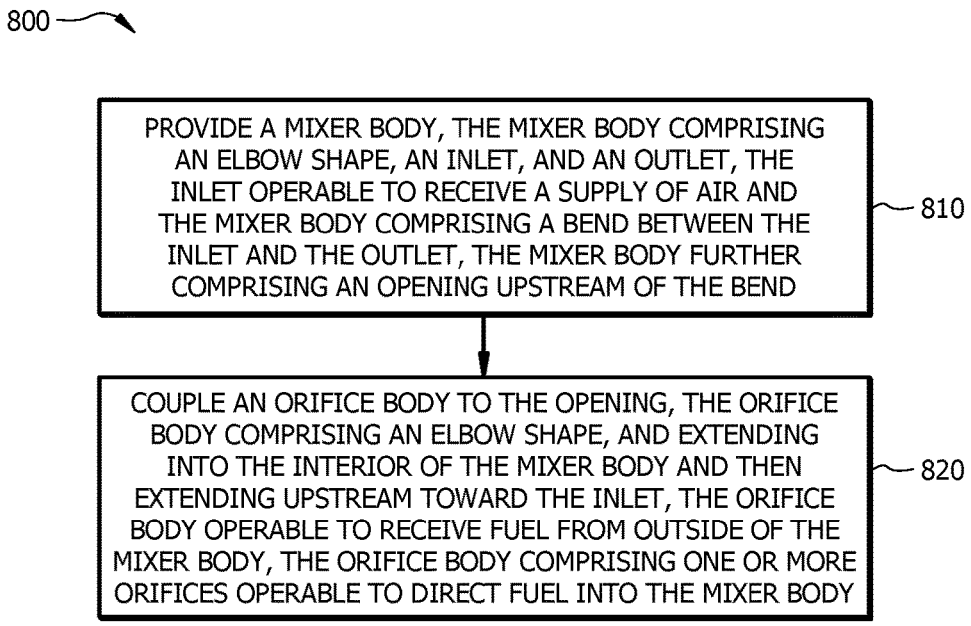
FIG. 8 is a flow chart diagram of a possible method embodiment under the present disclosure.

FIG. 8 displays another possible method embodiment 800 under the present disclosure. At 810, a mixer body is provided, the mixer body comprising an elbow shape, an inlet, and an outlet, the inlet operable to receive a supply of air and the mixer body comprising a bend between the inlet and the outlet, the mixer body further comprising an opening upstream of the bend. At 820, an orifice body is coupled to the opening, the orifice body comprising an elbow shape, and extending into the interior of the mixer body and then extending upstream toward the inlet, the orifice body operable to receive fuel from outside of the mixer body, the orifice body comprising one or more orifices operable to direct fuel into the mixer body.

Certain embodiments of the fuel-air or gas-air mixer assembly, or mixer body, described in the current disclosure can comprise an elbow shape that helps to assist in the mixing of the fuel and air. In a preferred embodiment, the elbow bends at approximately a 90 degree angle, ±5 degrees. However, the elbow shape can vary, using smaller or larger angles, such as ±15 degrees. The angles described can be measured by taking an axis from the center of a first and second portion of the mixer assembly. The first portion being upstream of the elbow bend, and the second portion being downstream of the bend.

The tip of the orifice body will preferably comprise one or more orifices to direct fuel into the mixer assembly to mix with air. The form, shape, size, and layout of the orifices can vary. They can be located at various locations on the orifice body. The orifice body will preferably be tubular or cylindrical, but can take other shapes.

A gas valve, such as described above, can provide fuel or gas to the orifice body. However other arrangements can comprise different embodiments under the present disclosure. The gas valve may be local or remote. A controller, thermostat, switch, or other controlling means can be coupled to the gas valve. Such coupling can be wired or wireless.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A fuel-air mixer assembly for use in HVAC systems comprising:

a burner assembly comprising an igniter;

a tube comprising an inlet and an outlet coupled to the burner assembly, wherein:

the tube comprising a bend between the inlet and the outlet, the inlet configured to receive a supply of air at the inlet; and the tube is configured to provide an air flow path from the inlet to the burner assembly;

a gas valve; and an orifice body at a location upstream of the bend and operably coupled to the gas valve, the orifice body comprising:

a first portion extending from a tube wall into the interior of the tube; and a second portion extending upstream within the interior of the tube, wherein:

the first and second portions connected by a curve, the first and second portions are configured to provide a fuel flow path from the gas valve to the interior portion of the tube;

the second portion extends against the air flow path of the tube;

the second portion comprising a tip distal to the curve, and the tip comprising one or more orifices operable to direct a supply of fuel into the tube.

2. The fuel-air mixer assembly of claim 1 wherein the one or more orifices comprise six orifices disposed on the circumference of the tip.

3. The fuel-air mixer assembly of claim 1 wherein the orifice body comprises a tubular shape.

4. The fuel-air mixer assembly of claim 1 further comprising a connection bracket at the outlet.

5. The fuel-air mixer assembly of claim 1 further comprising one or more mounting brackets.

6. The fuel-air mixer assembly of claim 1 further comprising a pressure sensor hole.

7. The fuel-air mixer assembly of claim 1 wherein the gas valve comprises a connection to a controller.

* * * * *